United States Patent [19]

Hoggard et al.

[11] Patent Number: 4,913,408

[45] Date of Patent: Apr. 3, 1990

[54] REFRACTORY LINER COMPOSITIONS

[75] Inventors: Dale B. Hoggard; Han K. Park, both of Pittsburgh, Pa.; Fiona C. R. Morrison, Northumberland, United Kingdom

[73] Assignee: Vesuvius Crucible Company, Pittsburgh, Pa.

[21] Appl. No.: 240,961

[22] Filed: Sep. 6, 1988

[51] Int. Cl.[4] ..... C21B 7/06; C04B 35/54

[52] U.S. Cl. ..... 266/280; 501/97; 501/98; 501/99; 501/100; 501/103; 501/105

[58] Field of Search ..... 501/99, 100, 103, 105, 501/97, 98; 266/280

[56] References Cited

U.S. PATENT DOCUMENTS

| | | | |
|---|---|---|---|
| 3,329,514 | 7/1967 | Saunders et al. | 501/99 X |
| 4,108,675 | 8/1978 | Tomita et al. | 501/100 |
| 4,804,644 | 2/1989 | Anseau et al. | 501/105 X |

FOREIGN PATENT DOCUMENTS

| | | | |
|---|---|---|---|
| 0084914 | 5/1983 | Japan | 501/100 |
| 0232967 | 12/1984 | Japan | 501/99 |

*Primary Examiner*—Mark L. Bell
*Assistant Examiner*—Karl Group
*Attorney, Agent, or Firm*—Webb, Burden, Ziesenheim & Webb

[57] ABSTRACT

A refractory liner composition which consists essentially of carbon and a composite selected from the group consisting of zirconia and O'-sialon and zirconia and silicon oxynitride.

11 Claims, 1 Drawing Sheet

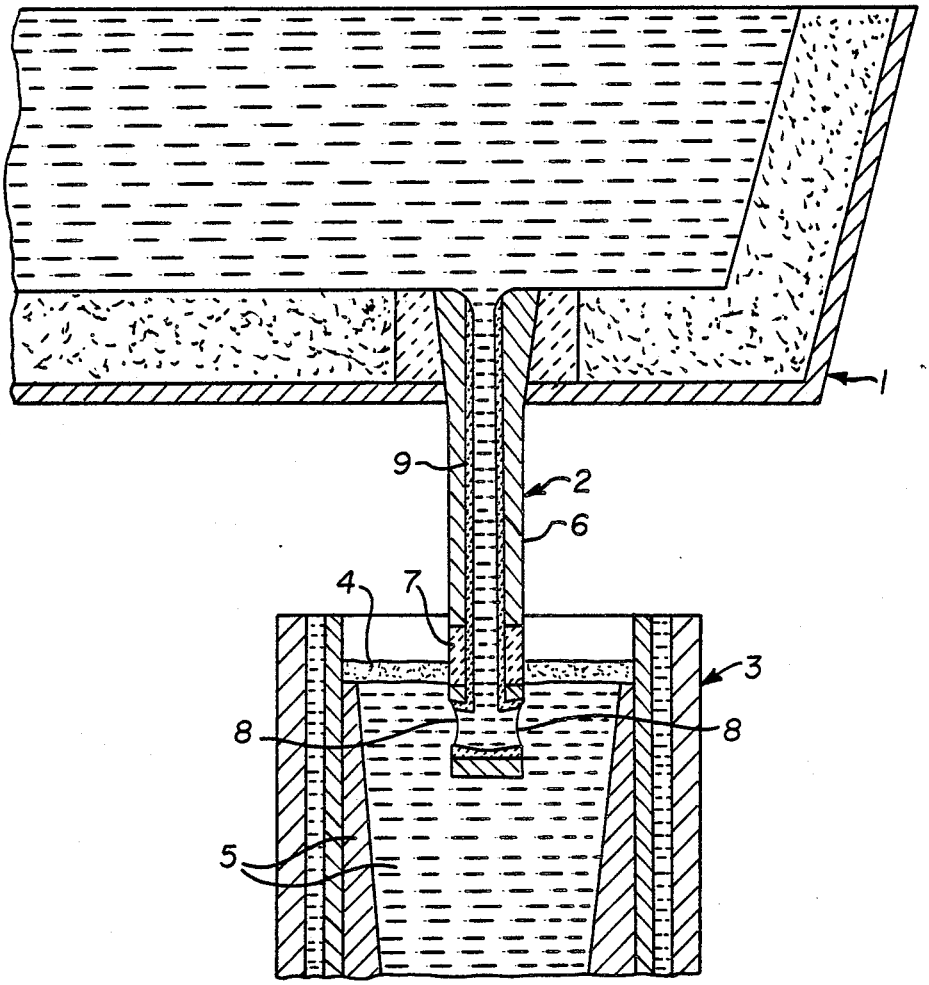
1
9
2
6
4
7
3
8
8
5

REFRACTORY LINER COMPOSITIONS

BACKGROUND OF THE INVENTION

The present invention relates to refractory liner compositions and, in particular, to refractory liner compositions that will resist the build up of alumina or other oxides during the continuous casting of molten steel.

In the continuous casting of steel, special refractories are used to control the flow of the molten steel and to protect the molten steel from oxidation as it is poured from steel ladles to tundishes and from tundishes to continuous casting moulds. Such refractories include slide gate plates or stopper rods used in molten metal flow control, various collector nozzles in ladles and tundishes, and protective ladle shrouds and submerged pouring nozzles to protect the molten metals from oxidation. These types of speciality refractories are subjected to severe thermal shock, molten steel erosion, and slag attack.

These speciality refractories are usually carbon-containing refractories and more specifically carbon-bonded refractories. They are usually composed of refractory grain such as aluminium oxide, zirconium oxide, clays, magnesium oxide, silicon carbide, silica, or other dense grain of specific mesh size; carbon from flake graphite, amorphous graphite, carbon black, coke, etc.; and a carbonaceous binder derived from pitch or resin.

Some oxidation takes place during the manufacture of steel, and considerable amounts of oxygen may dissolve in the molten metal. In the ensuing solidification of the steel during casting much of the dissolved gas is expelled and, in the case of oxygen, reacts with carbon to produce evolved carbon monoxide. The dispelled oxygen, carbon monoxide and other gases create undesirable porosity, cracks, and internal defects which lower the quality of the finished steel. In order to eliminate the problem of dissolved oxygen, molten steels are deoxidized or "killed" by the addition of aluminium metal, ferromanganese, or ferrosilicon. In the case of aluminum-killed steel, the aluminium reacts with the dissolved oxygen or iron oxide to form finely-dispersed aluminium oxide, some of which floats into the slag above the molten steel and some of which remains as highly-dispersed micro particles in the solidified steel. During continuous casting, this extremely fine alumina has a tendency either to precipitate out of the molten steel onto the cooler refractory surfaces or to react and stick to the ceramic refractories that line the molten steel path from ladle to tundish to casting mould.

This precipitated alumina has a particular affinity to the typical carbon-bonded alumina-graphite refractories utilized as ladle shrouds and submerged pouring nozzles, which are often referred to as subentry nozzles (SEN). The alumina will continue to build up in the subentry nozzles until the flow of molten steel is reduced to the point that the tube must be lanced by an oxygen torch, or discarded. If oxygen lancing becomes necessary, the casting process is disrupted costing time and money, the casting efficiency decreases, and the quality of the steel must be downgraded. A total alumina blockage of a subentry nozzle decreases the expected life of the refractories and is very costly to steel producers. In aluminum-killed steels where high dissolved-oxygen concentrations are expected, the useful life of a submerged pouring nozle may be limited to 2–3 ladles due to the heavy alumina build up on the interior diameter of the tube.

We have now developed particular refractory compositions that can be formed into interior liner materials on submerged pouring nozzles, ladle shrouds, collector nozzles, etc., and thereby prevent or inhibit the build up of alumina or other oxides thereon during the production of molten steel during continuous casting.

SUMMARY OF THE INVENTION

Accordingly, the present invention provides a refractory liner composition which comprises carbon and a composite of zirconia and O'-sialon or silicon oxynitride.

Ceramic materials containing the element Si, Al, O and N are generically termed sialons. O'-Sialon is the solid solution formed by dissolving alumina in silicon oxynitride. The replacement that occurs is the replacement of Si by Al and N by O, there being a range of solubility of alumina in the $Si_2N_2O$ structure. The general formula for O'-sialon is $Si_{2-x}Al_xO_{1+x}N_{2-x}$ where x is less than 0.2, giving a limiting composition of $Si_{1.8}Al_{0.2}O_{1.2}N_{1.8}$.

The composites of zirconia and O'-sialon and zirconia and silicon oxynitride are discussed in EP-A-0247878 in the name of Cookson Group Plc.

Essentially, the reaction to form composite of zirconia and O'-sialon comprises the reaction sintering at a temperature in the range of from 1500° to 1750° C. of zircon ($ZrSiO_4$), silicon nitride ($Si_3N_4$) and alumina ($Al_2O_3$) or a precursor for alumina, optionally in the presence of a reaction sintering aid, or a precursor therefore. The reaction proceeds according to the following equation which is for illustrative purposes only, the actual composition of the O'-sialon and the amount of zirconia in the composite depending upon the amount of the reactants:

$$9ZrSiO_4+9Si_3N_4+2Al_2O_3 \rightarrow 2Si_{1.8}Al_2O_{1.2}N_{1.8}+ZrO_2 \text{ (O'-sialon)}$$

When alumina is omitted from the above reaction a composite of silicon oxynitride and zirconia is formed, the reaction proceeding according to the equation:

$$ZrSiO_4+Si_3N_4 \rightarrow 2Si_2N_2O+ZrO_2$$

The refractory liner compositions of the present invention contain carbon which is preferably in the form of graphite in an amount of from 4 to 50% by weight of the composition. The graphite may be present as flake graphite or amorphous graphite. The refractory liner compositions of the present invention will generally include therein the composite of zirconia and O'-sialon or zirconia and silicon oxynitride in an amount of from 20 to 90% by weight of the composition, preferably in an amount of from 40 to 70% by weight of the composition.

The refractory liner compositions of the present invention will also preferably include therein a binder, generally in an amount of up to 20% by weight of the composition, the binder preferably being a carbonaceous material such as pitch or a resin binder.

The refractory liner composition of the present invention may also include one or more additional refractory materials such as clay, alumina, zirconia, zircon, silica, silicon carbide, mullite chromia, iron chromite or magnesia in an amount of up to 70% by weight.

The actual amount of zirconia in the composite can be varied according to the amount of zircon reacted with silicon nitride in the initial mixture. The zirconia may be unstabilised (monoclinic) partially-stabilised (cubic/tetragonal-monoclinic) or fully stabilized (cubic/tetragonal) depending upon the amount of any stabilising compound reacted in the reactant mixture. Suitable stabilizing compounds include, but are not limited to the following: calcium oxide, magnesium oxide, yttrium oxide, or any other number of rare earth oxides.

BRIEF DESCRIPTION OF THE DRAWING

FIG. 1 is a cross-sectional side elevation view of a tundish and subentry nozzle having a refractory liner composition of the present invention.

DETAILED DESCRIPTION OF THE INVENTION

The present invention will be further described with reference to the following Example.

EXAMPLE 1

The technology of using a submerged entry nozzle for the casting of a molten metal from a tundish to a water-cooled mould is well known. FIG. 1 of the accompanying drawings illustrates a typical apparatus. The molten metal flows from the tundish 1 through the submerged nozzle 2 and exits from the nozzle beneath the surface of the molten steel in the water-cooled mould. The use of the submerged nozzle prevents oxidation and splashing of the molten metal. A layer of mould powder 4 is placed on top of the molten metal in the water-cooled mould 3. The mould powder 4 is used to trap nonmetallic inclusions in the molten metal. The mould powder 4 also serves as a lubricant and protection for the strands of metal 5 as they are extracted from the water-cooled mould. Mould powder 4 is normally comprised of mixed oxides which have a low melting point.

The submerged entry nozzle 2 is generally a carbon-containing body made of two different compositions. The main part of the nozzle 6 is composed of carbon-bonded alumina and graphite whilst the slagline area comprises a sleeve 7 of carbon-bonded zirconia and graphite. The nozzle includes one or more exit ports 8 through which the molten steel is casted. The typical chemistry of the alumina-graphite and zirconia-graphite refractories used in the formation of the submerged entry nozzle are given in Table I by weight percent.

TABLE I

| | Alumina Graphite | Zirconia Graphite |
|---|---|---|
| C | 32.0 | 16.5 |
| $Al_2O_3$ | 52.0 | 1.0 |
| $SiO_2$ | 14.0 | 2.0 |
| Minor | 2.0 | 1.5 |
| $ZrO_2$ | — | 75.0 |
| CaO | — | 4.0 |

A refractory liner 9 was included on the interior of the submerged entry nozzle 2.

The laboratory testing for alumina build up resistance of varous refractory liner materials consisted of rotating erosion bars of each of the liner materials in molten low-carbon steel at temperatures in the range of from 1630° C. to 1730° C. Prior to dipping, the molten steel was stirred with an oxygen lance to ensure an abundance of dissolved oxygen. Up to ½ weight percent of aluminium metal was then added to the molten steel to deoxidize of "kill" the steel. Generally four sample bars, each 20 mm × 20 mm × 150 mm in length, were mounted together, immersed in the aluminum-killed steel, and rotated for 10 minutes at 20 rpm. The alumina build up on each sample was ascertained by visual inspection and a comparative ranking was given to each composition based upon the amount of alumina present and the steel erosion resistance of the material. This comparative ranking is somewhat subjective, but the results of accumulated steel erosion tests give an accurate picture of the material's ability to resist alumina build up.

Below in Table II a summary is given which details the compositions tested and the comparative alumina build up ranking thereof. The well known alumina-graphite and zirconia-graphite materials served as standards in these tests. The physical properties of the materials tested are given in Table III.

The test results reported in Table II demonstrate that the refractory linear material in accordance with the present invention (Composition No. 3) based on the carbon-bonded zirconia and O'-sialon system is clearly superior to other carbon-bonded systems including those based on β-sialon.

TABLE II

Composition of Anti-build up Liner Materials (wt. %)

| Composition | 1* | 2** | 3 | 4 | 5 | 6 | 7 |
|---|---|---|---|---|---|---|---|
| C | 32.0 | 16.5 | 31.5 | 29.1 | 31.2 | 29.4 | 21.0 |
| b-sialon | — | — | — | 51.6 | 14.1 | 66.8 | 33.0 |
| $Si_3N_4$ | — | — | — | — | 24.1 | — | — |
| Zirconia and O'-sialon composite*** | — | — | 65.9 | — | — | — | — |
| $Al_2O_3$ | 52.0 | 1.0 | — | — | 0.7 | 0.4 | — |
| $ZrO_2$ | — | 75.0 | — | 16.9 | 17.2 | — | 42.0 |
| $SiO_2$ | 14.0 | 2.0 | — | — | 10.3 | 0.8 | 1.0 |
| CaO | — | 4.0 | — | — | — | — | 2.0 |
| Minor Addition | 2.0 | 1.5 | 2.6 | 2.5 | 2.5 | 2.6 | 1.0 |
| Alumina build up Resistance Ranking (1 = excellent, 4 = Poor) | 3.5 | 2.6 | 1.7 | 2.2 | 2.1 | 1.9 | 2.1 |

*Standard Alumina-Graphite as per Table I
**Standard Zirconia-Graphite as per Table II
***85 v/o O'-Sialon and 15 v/o $ZrO_2$

TABLE III

Physical Properties of Anti-build up Liner Materials (wt. %)

| Composition | 1 | 2 | 3 | 4 | 5 | 6 | 7 |
|---|---|---|---|---|---|---|---|
| Porosity, % | 17.0 | 19.0 | 21.0 | 17.0 | 19.5 | 16.1 | 15.8 |
| Bulk Density, g/cc | 2.37 | 3.49 | 2.25 | 2.41 | 2.27 | 2.22 | 2.95 |
| Apparent Specific Gravity | 2.86 | 4.31 | 2.85 | 2.90 | 2.82 | 2.65 | 3.50 |
| Modulus of Rupture, psi | | | | | | | |
| Vertical | 1078 | 638 | 1832 | 1727 | 1658 | 1662 | 1585 |
| Horizontal | 1407 | 1025 | 1851 | 1847 | 1823 | 1675 | 1761 |
| Thermal Expansion Coefficient, $\times 10^6$ °C.$^{-1}$ | 4.01 | 5.43 | 3.35 | 3.50 | 3.02 | 3.41 | — |

We claim:

1. A refractory liner composition for resisting buildup of oxides during metal casting operations which consists essentially of carbon and a composite selected from the group consisting of (a) zirconia and O'-sialon, and (b) zirconia and silicon oxynitride.

2. A refractory liner composition according to claim 1 which includes therein a binder.

3. A refractory liner composition according to claim 2 wherein the binder is included in an amount of up to 20% by weight of the composition.

4. A refractory liner composition according to claim 1 which includes one or more additional refractory materials therein.

5. A refractory liner composition according to claim 4 wherein the additional refractory material is included in an amount of up to 70% by weight of the composition.

6. A refractory liner composition according to claim 1 wherein the composite is included in an amount of from 20 to 90% by weight of the composition.

7. A refractory linear composition according to claim 6 wherein the composite is included in an amount of from 40 to 70% by weight of the composition.

8. A refractory liner composition according to claim 1 wherein the carbon therein is in the form of graphite.

9. A liner for resisting buildup of oxides during metal casting operations which comprises a refractory material consisting essentially of carbon and a composite selected from the group consisting of (a) zirconia and O'-sialon, and (b) zirconia and silicon oxynitride.

10. A subentry nozzle for use in casting molten metal, said nozzle comprising a body of a refractory material and having a refractory liner portion formed therein and adapted to resist oxide buildup during casting operations, said refractory liner consisting essentially of carbon and a composite selected from the group consisting of (a) zirconia and O'-sialon, and (b) zirconia and silicon oxynitride.

11. The subentry nozzle of claim 10 wherein the nozzle body is a carbon bonded metal oxide refractory material and wherein the carbon present in the liner portion is supplied predominately from a graphite source.

* * * * *

UNITED STATES PATENT AND TRADEMARK OFFICE

CERTIFICATE OF CORRECTION

PATENT NO. : 4,913,408

DATED : April 3, 1990

INVENTOR(S) : Dale B. Hoggard, Han K. Park and Fiona C. R. Morrison

It is certified that error appears in the above-identified patent and that said Letters Patent is hereby corrected as shown below:

Claim 7 Line 15 Column 5 "linear" should read --liner--.

Signed and Sealed this

Seventh Day of May, 1991

*Attest:*

HARRY F. MANBECK, JR.

*Attesting Officer*

*Commissioner of Patents and Trademarks*